US006870505B2

(12) United States Patent
Aisenbrey

(10) Patent No.: US 6,870,505 B2
(45) Date of Patent: Mar. 22, 2005

(54) MULTI-SEGMENTED PLANAR ANTENNA WITH BUILT-IN GROUND PLANE

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 15 days.

(21) Appl. No.: 10/353,555

(22) Filed: Jan. 29, 2003

(65) Prior Publication Data

US 2004/0174301 A1 Sep. 9, 2004

Related U.S. Application Data

(60) Provisional application No. 60/392,858, filed on Jul. 1, 2002.

(51) Int. Cl.[7] ..... H01Q 1/38

(52) U.S. Cl. ..... 343/700 MS; 343/846; 343/830

(58) Field of Search ..... 343/700 MS, 829, 343/830, 846, 848, 853, 855, 893

(56) References Cited

U.S. PATENT DOCUMENTS 4,410,891 A 10/1983 Schaubert et al. ... 343/700 MS
5,777,583 A * 7/1998 Canora et al. ..... 343/700 MS
6,097,345 A 8/2000 Walton ..... 343/769
6,133,878 A * 10/2000 Lee ..... 343/700 MS
6,268,831 B1 * 7/2001 Sanford ..... 343/702
6,329,950 B1 12/2001 Harrell et al. ..... 343/700 MS
6,346,914 B1 * 2/2002 Annamaa ..... 343/700 MS
6,429,828 B1 8/2002 Tinaphong et al. ..... 343/824
6,492,947 B2 * 12/2002 Anderson ..... 343/700 MS
6,552,696 B1 * 4/2003 Sievenpiper et al. ..... 343/909
6,556,169 B1 * 4/2003 Fukuura et al. ..... 343/700 MS
6,600,449 B2 * 7/2003 Onaka et al. ..... 343/700 MS
6,639,558 B2 * 10/2003 Kellerman et al. .. 343/700 MS

* cited by examiner

*Primary Examiner*—Shih-Chao Chen
(74) *Attorney, Agent, or Firm*—George O. Saile; Stephen B. Ackerman; Larry J. Prescott

(57) ABSTRACT

A multi-segmented planar antenna with a built in ground plane and method of forming the antenna are described. The antenna elements are formed on a layer of first dielectric having conducting material on both the first and second sides of the layer of first dielectric, such as a printed circuit board. Antenna elements are formed on both sides of the layer of first dielectric using selective etching of the conducting material. Two antenna elements are generally rectangular separated by a narrow gap and electrically connected by two shorting strips across the gap. Two antenna elements are long and narrow wherein the length of each is an integral multiple of a quarter wavelength of the operating frequencies of the antenna A layer of second dielectric is placed between the layer of first dielectric having the antenna elements and a ground plane. The antenna can be fully encapsulated in a plastic encapsulation material.

29 Claims, 7 Drawing Sheets

MULTI-SEGMENTED PLANAR ANTENNA WITH BUILT-IN GROUND PLANE

This application claims priority to US Provisional Patent Application Ser. No. 60/392,858, filed Jul. 1, 2002 which is herein incorporated by reference.

BACKGROUND OF THE INVENTION (1) Field of the Invention

This invention relates to a planar antenna having a built in ground plane, a low profile, and small area which has excellent performance in close proximity to either a conducting or non conducting surface.

(2) Description of the Related Art

A number of workers have disclosed planar type antennas.

U.S. Pat. No. 6,329,950 B1 describes a planar antenna having two joined conducting regions connected to a coaxial cable.

U.S. Pat. No. 4,410,891 to Sehaubert et al. describes a microstrip antenna the polarization of which can easily be changed.

U.S. Pat. No. 6,097,345 to Walton describes a dual band slot antenna for cellular telephone and global positioning system frequency bands.

U.S. Pat. No. 6,429,828 B1 to Tinaphong et al. describes a VHF/UHF self-tuning planar antenna system.

SUMMARY OF THE INVENTION

Antennas are essential in any electronic systems containing wireless links. Such applications as communications and navigation require reliable sensitive antennas. It is very desirable if these antennas are compact, stable, and are not affected by the proximity of either conductive or non conductive surfaces.

In is a principle objective of this invention to provide a very low profile, small area antenna that has excellent performance in close proximity to either conducting or non conductive surfaces.

In is another principle objective of this invention to provide a method of forming very low profile, small area antenna that has excellent performance in close proximity to either conducting or non conductive surfaces.

These objectives are achieved using a multi-segmented planar antenna with a built in ground plane. The antenna elements are formed on a layer of first dielectric having conducting material on both the first and second sides of the layer of first dielectric, such as a printed circuit board. First and second antenna elements are formed on the first side of the layer of first dielectric using selective etching of the conducting material on the first side of the layer of dielectric. Third and fourth antenna elements are formed on the second side of the layer of first dielectric using selective etching of the conducting material on the second side of the layer of dielectric.

The first and second antenna elements are generally rectangular separated by a narrow gap and electrically connected by two shorting strips across the gap. The third and fourth antenna elements are long and narrow wherein the length of the third antenna element is an integral multiple of a quarter wavelength of a first frequency and the length of the fourth antenna element is an integral multiple of a quarter wavelength of a second frequency. The first and second frequencies are the operating frequencies of the antenna The widths of the segments of the third antenna element are not the same. The widths of the segments of the fourth antenna element are not the same. Conducting vias connect the first antenna element with the first end of the and third antenna element and the second antenna element with the first end of the fourth antenna element. A small shorting strip electrically connects the second end of the third antenna element to the second end of the fourth antenna element.

A layer of second dielectric is placed between the layer of first dielectric having the first, second, third, and fourth antenna elements and a ground plane. A cavity is formed in the layer of second dielectric for a coaxial cable. The center conductor of the coaxial cable is connected to the second end of the third antenna element. The shield of the coaxial cable is connected to the ground plane. Two conducting pins connect the second antenna element to the ground plane. The antenna element can be fully encapsulated in a plastic encapsulation material having an exit port for the coaxial cable, thereby protecting the antenna assembly from the effects of the environment.

DESCRIPTION OF THE PREFERRED EMBODIMENTS

Figure 1:
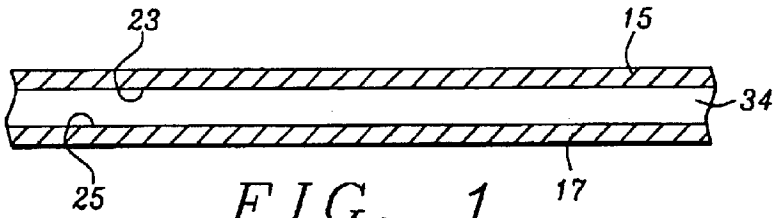
FIG. 1 shows a cross section view of the circuit board on which the antenna elements are to be formed.

Refer now to FIGS. 1–9 for a description of the preferred embodiment of the antenna of this invention. FIG. 1 shows a cross section view of a layer of first dielectric material 34 having a top surface 23 and a bottom surface 25. A first layer of conducting material 15 is formed on the top surface 23 of the layer of first dielectric material 34 and a second layer of conducting material 17 is formed on the bottom surface 25 of the layer of first dielectric material 34. As an example the first 15 and second 17 layers of conducting material can be a metal such as copper and formed on the layer of first dielectric material 34 by means of deposition, lamination, plating, or the like. This layer of dielectric with conducting material on the top and bottom is used to form the antenna elements of this antenna FIG. 2A shows a top view of the layer of dielectric material with conducting layers on both the top and the bottom showing a first antenna element 12 and a second antenna element 14 formed in the first layer of conducting material using a means such as selective etching. The layer of dielectric material with conductive layers on both the top and the bottom has a rectangular shape with a first length 112 and a first width 110. A notch 10 is removed from the layer of dielectric material with conductive layers on both the top and the bottom to accommodate and additional antenna if one is desired. The notch has a second length 116 and a second width 114. The first antenna element 12 is separated from the second antenna element 14 by a gap having a first segment 16A, a second segment 16B, and a third segment 16C each segment having a third width 22. A fist shorting strip 19 separates the second segment 16B of the gap from the third segment 16C of the gap and electrically connects the first antenna element 12 to the second antenna element 14. A second shorting strip 21 separates the first segment 16A of the gap from the second segment 16B of the gap and electrically connects the first antenna element 12 to the second antenna element 14. The first shorting strip 19 and the second shorting strip 21 have the same width, a fourth width 18. The antennas' resonance frequencies and resonance impedances can be fine tuned by the location of the first 19 and second 21 shorting strips of the antenna There is a conducting path 30 between the first antenna element 12 and a third antenna element and a conducting path 28 between the second antenna element 14 and a fourth antenna element. There are conducting paths, 24 and 26, between the second antenna element 14 and a ground plane. The third and fourth antenna elements and the ground plane are yet to be described.

Figure 2A:
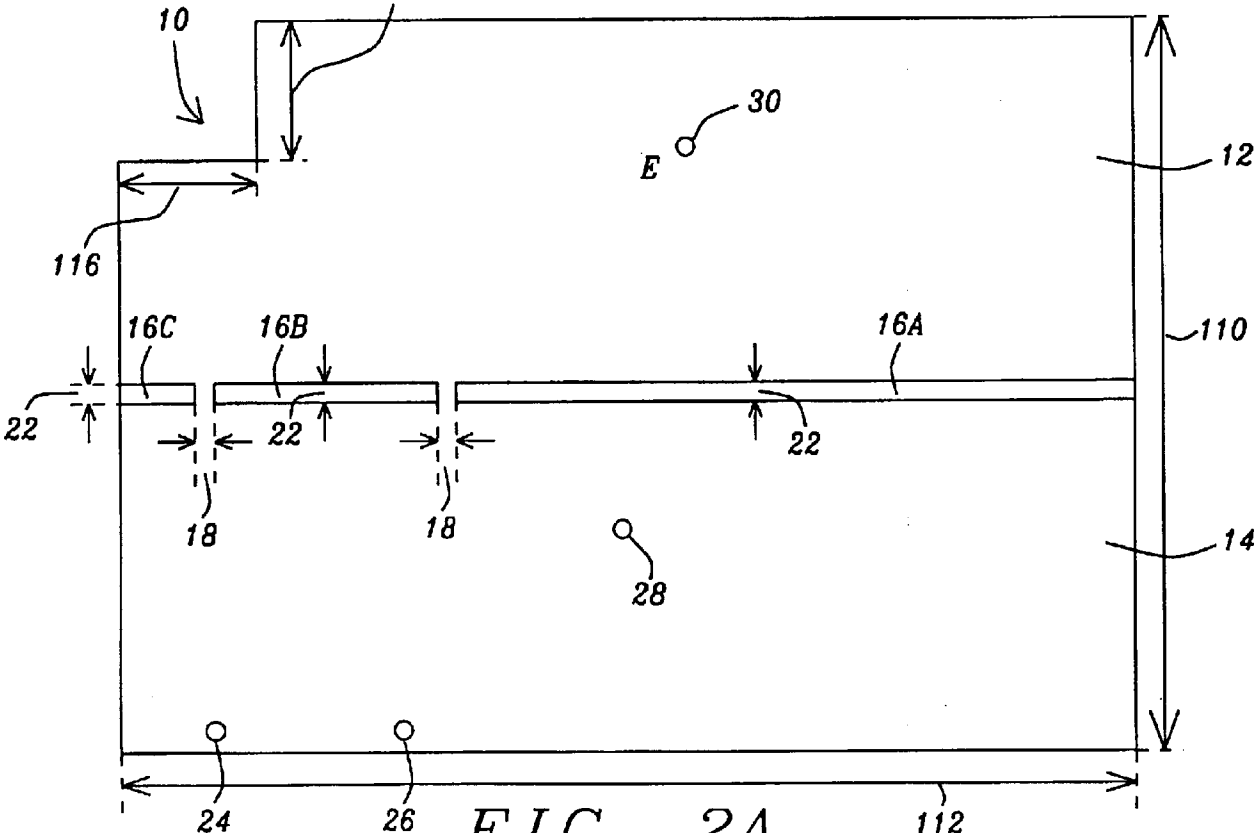
FIG. 2A shows the top view of the first and second antenna elements.
Figure 2B:
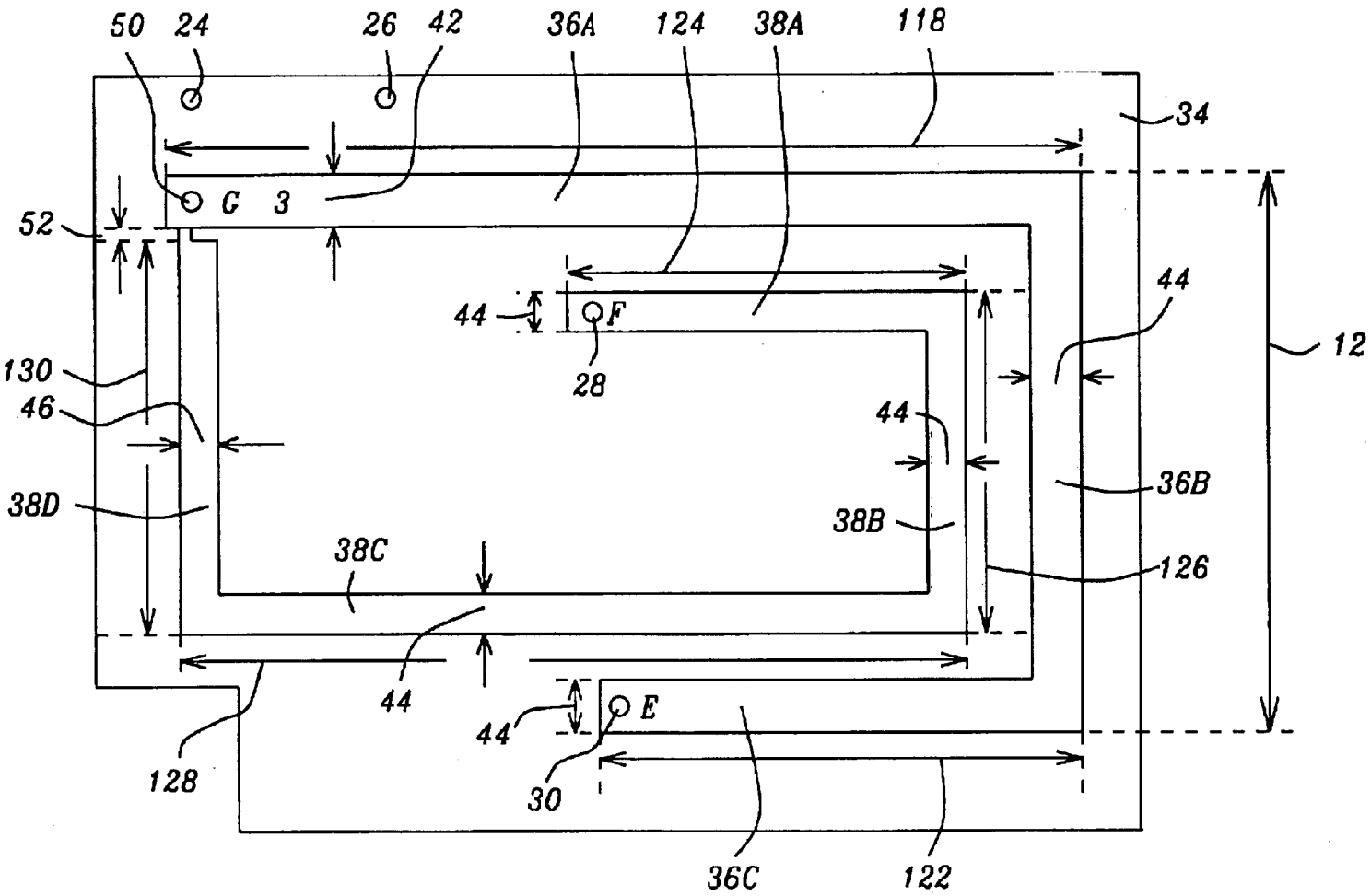
FIG. 2B shows the bottom view of the third and fourth antenna elements.

FIG. 2B shows a bottom view of the layer of dielectric material with conducting layers on both the top and the bottom showing a third antenna element; 36A, 36B, and 36C; and a fourth antenna element;38A, 38B, 38C, and 38D; formed in the second layer of conducting material using a means such as selective etching. The third antenna element has a first segment 36A having a fifth width 42 and a third length 118, a second segment 36B having a sixth width 44 and a fourth length 120, and a third segment 36C having the sixth width 44 and a fifth length 122. The fourth antenna element has a first segment 38A having the sixth width 44 and a sixth length 124, a second segment 38B having the sixth width 44 and a seventh length 126, a third segment 38C having the sixth width 44 and an eighth length 128, and a fourth segment 38B having the sixth width 44 and a ninth length 130. The sum of the third 118, fourth 120 and fifth 122 lengths is equal to an integral multiple of one quarter of the wavelength of a first frequency. The sum of the sixth 124, seventh 126, eighth 128, and ninth 130 lengths is equal to an integral multiple of one quarter of the wavelength of a second frequency.

Figure 3B:
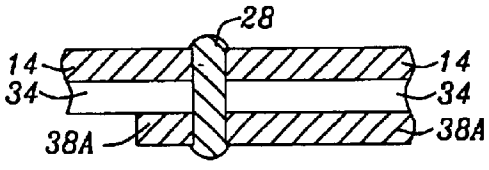
FIG. 3B shows a cross section view of a part of the circuit board on which the antenna elements are formed showing the conducting path between the second and fourth antenna elements.
Figure 3A:
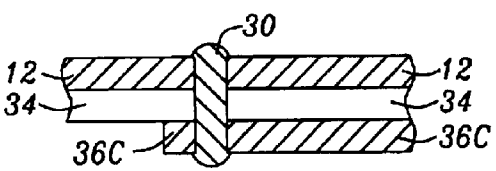
FIG. 3A shows a cross section view of a part of the circuit board on which the antenna elements are formed showing the conducting path between the first and third antenna elements.

The fifth 42 and sixth 44 widths are chosen to achieve the desired impedance of the third and fourth antenna elements. A third shorting strip 40 having a tenth width 52 electrically connects one end of the first segment 36A of the third antenna element with one end of the fourth segment 38D of the fourth antenna element. As shown in FIGS. 2B and 3A the conducting path 30 between the third antenna element and the first antenna element is located at the free end of the third segment 36C of the third antenna element and goes directly through the layer of first dielectric 34. As shown in FIGS. 2B and 3B the conducting path 28 between the fourth antenna element and the second antenna element is located at the free end of the first segment 38A of the fourth antenna element and goes directly through the layer of first dielectric 34. As an example these conducting paths, 28 and 30, can be plated through holes, filled holes, or like. One end of the first segment 36A of the first antenna element has a contact point 50 for connection to the center conductor of a coaxial cable.

As an example the first frequency is between about 148 and 151 MHz and the second frequency is between about 136 and 140 MHz. The dimensions of the antenna are scaled to correspond to the desired frequencies and examples of some of the dimensions of the antenna will be given to correspond to the example frequencies. Those skilled in the art will readily recognize that the antenna dimensions can be scaled to operate at other frequencies. In this example the first length 112 is about 10.25 inches and the first width 110 is about 7.25 inches. The second length 116 and the second width 114 are both between about 1.0 and 1.375 inches. The third width 22 is about 1/32 inches and the fourth width 18 is between about 0.05 and 0.25 inches, see FIG. 2A.

In this example the third length 118 is about 9.125 inches, the fourth length 120 is about 5.3125 inches, and the fifth length 122 is about 4.1875 inches which is consistent with the first frequency of between about 148 and 151 MHz. In this example the sixth length 124 is about 3.635, the seventh length 126 is about 3.4375 inches, the eighth length 128 is about 8.0 inches, and the ninth length 130 is about 4.0 inches which is consistent with the second frequency of between about 136 and 140 MHz. As previously indicated the dimensions can be scaled to achieve an antenna having good operating characteristics at different frequencies.

Figure 4:
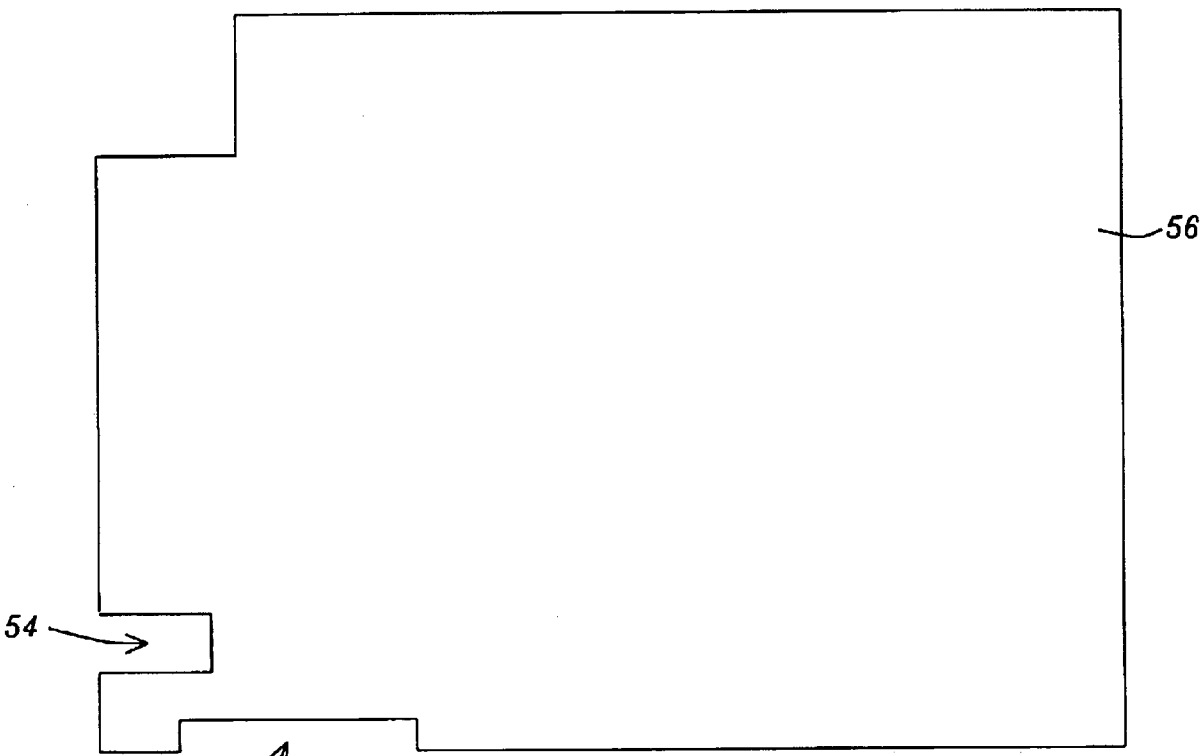
FIG. 4 shows a top view of the layer of dielectric placed between the circuit board on which the antenna elements are formed and the ground plane.
Figure 5:
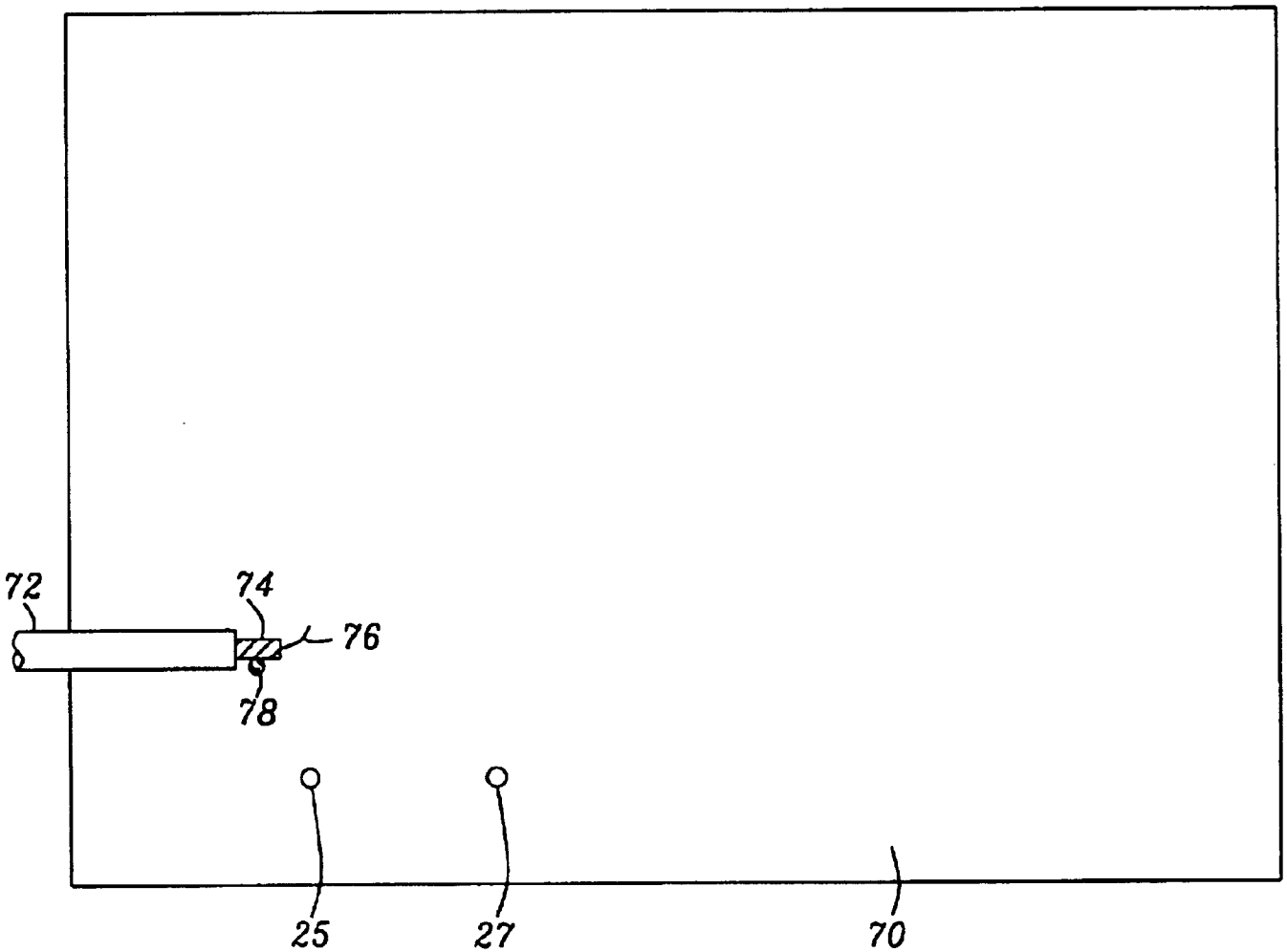
FIG. 5 shows a top view of the ground plane showing the connection between a coaxial cable shield and the ground plane.

FIG. 4 shows a top view of a layer of second dielectric 56 which will be placed between the layer of first dielectric having the first, second, third, and fourth antenna elements formed thereon and a ground plane. The layer of second dielectric 56 has a first cavity 54 formed therein to enable a coaxial cable to make connections to the contact point 50 on the first segment 36A of the third antenna clement as well as to the ground plane. The layer of second dielectric 56 can also have a second cavity 58 formed therein to accommodate an edge connector, not shown. FIG. 5 shows a top view of a ground plane 70 of the antenna of this invention. The ground plane is a conducting material such as copper. The ground plane 70 has a contact region 78 to connect to the shield 74 of a coaxial cable 72. The center conductor 76 of the coaxial cable 72 is to be connected to the third antenna element. The ground plane 70 also has connection points, 25 and 27, to connect to the conducting paths, 24 and 26 shown in FIG. 2A, between the second antenna element and the ground plane.

Figure 6:
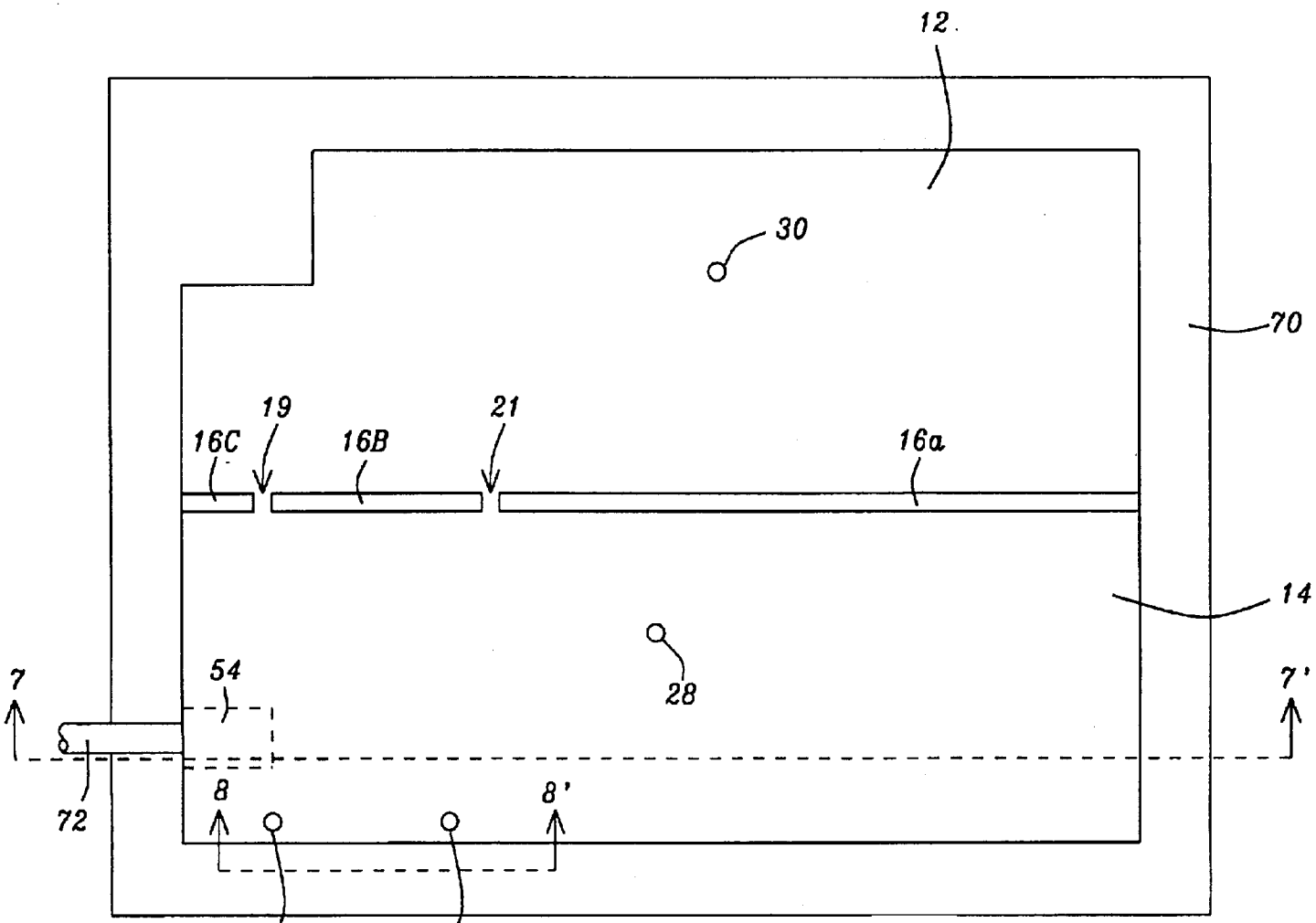
FIG. 6 shows a top view of the completed antenna
Figure 7:
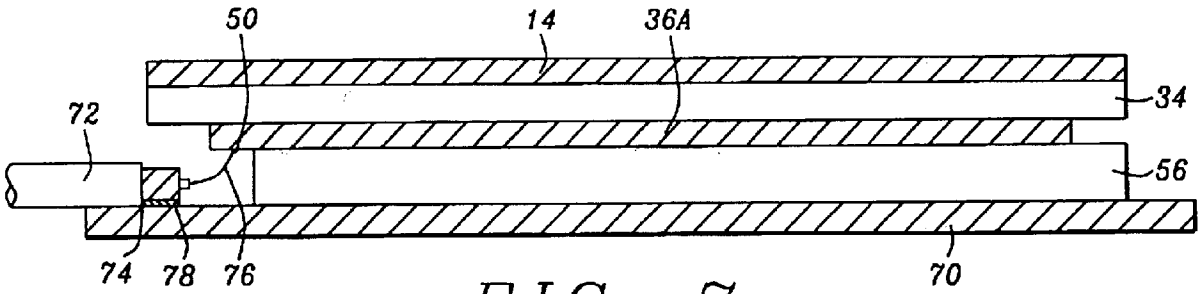
FIG. 7 shows a cross section view of the completed antenna showing the connection of the center conductor of a coaxial cable to the third antenna element.
Figure 8:
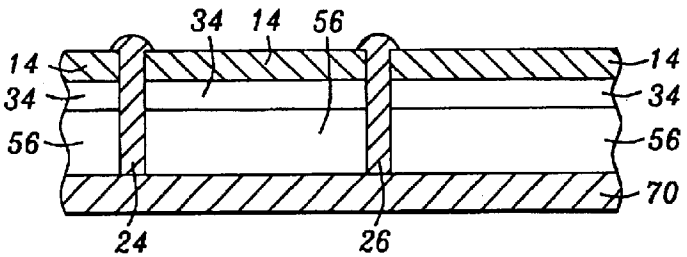
FIG. 8 shows a cross section view of the completed antenna showing the conducting paths between the second antenna element and the ground plane.

FIG. 6 shows a top view of the completed antenna assembly. FIG. 7 shows a cross section view of the completed antenna assembly taken along line 7–7' of FIG. 6. FIG. 7 shows the connection of the center conductor 76 of the coaxial cable 72 to the connection region 50 on the first segment 36A of the third antenna element and the connection of the shield 74 of the coaxial cable 72 to the connection region 78 on the ground plane 70. FIG. 8 shows a cross section view of a part of the completed antenna assembly taken along line 8–8' of FIG. 6. FIG. 8 shows the conduction paths, 24 and 26, between the second antenna element 14 and the ground plane 70. As shown in FIG. 8 all of the conducting material has been removed from this region of the second surface of the layer of first dielectric 34.

Figure 9:
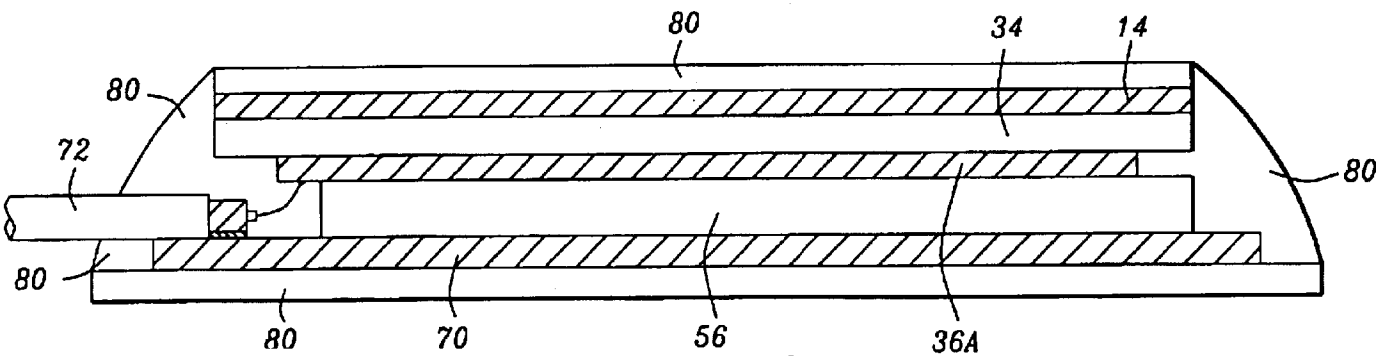
FIG. 9 shows a cross section view of the completed antenna which has been encapsulated in plastic.

As shown in FIG. 9, the antenna assembly can be fully encapsulated in a plastic material 80 or other suitable insulating and encapsulating material. The cross section of the antenna assembly shown in FIG. 9 is also taken along line 7–7' of FIG. 6. As shown in FIG. 9, the plastic encapsulating material 80 covers the ground plane 70, the top of the antenna assembly, and the edges of the antenna assembly. The coaxial cable 72 extends through the plastic encapsulating material 80.

The antenna described herein can be scaled to operate efficiently at frequencies between about 3 KHz to 300 GHz.

Figure 10:
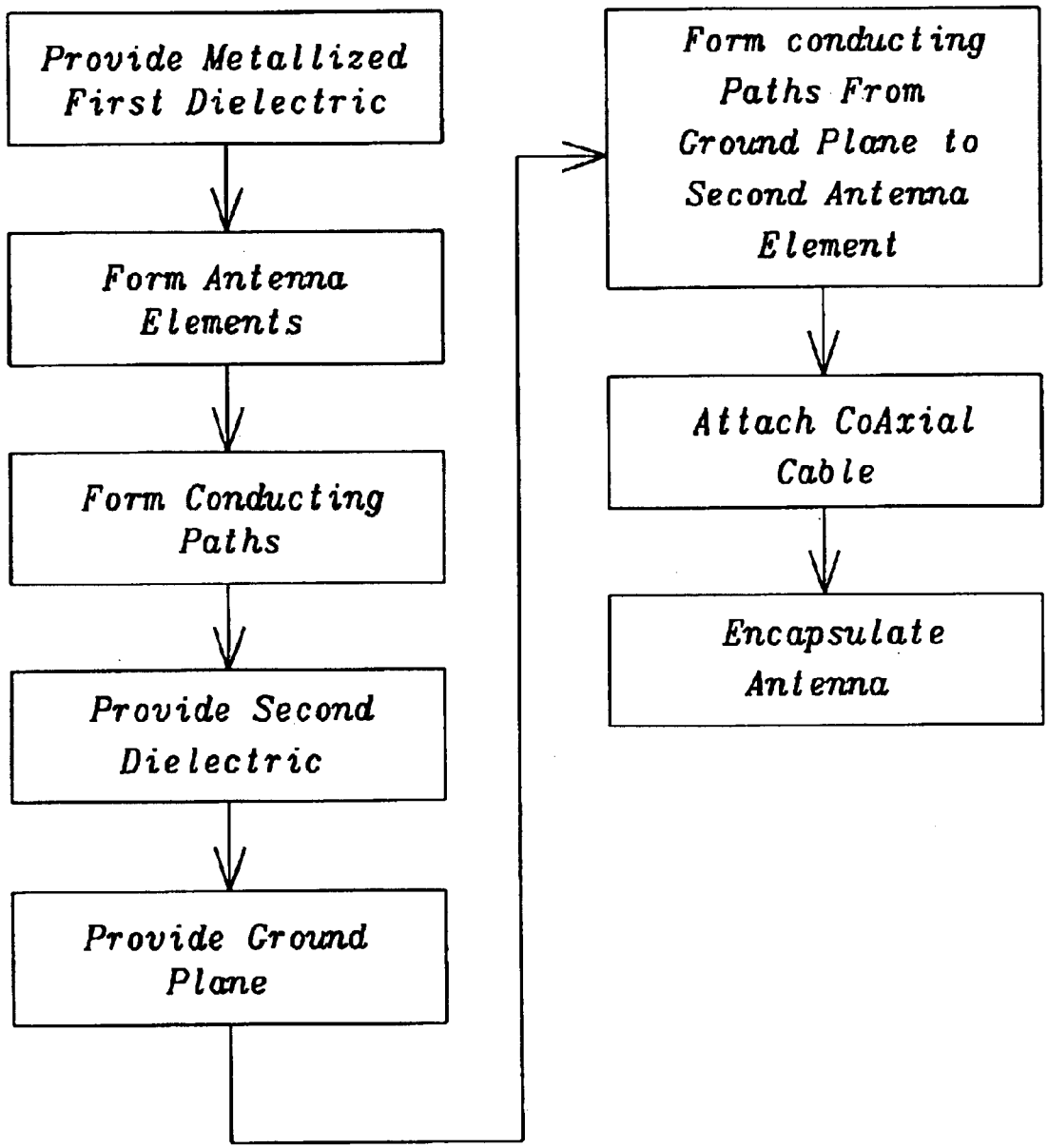
FIG. 10 shows a flow diagram of the method of this invention.

FIG. 10 shows a flow diagram of the method of forming an antenna of this invention. As shown in the first box 140, a layer of first dielectric material having a top surface, a bottom surface, a first layer of conducting material on the top surface of the layer of first dielectric material, and a second layer of conducting material formed on the bottom surface of the layer of first dielectric material is provided. As shown in the next box 142, the antenna elements and shorting strips are formed in the first and second layers of conducting material. As shown in the next box 144, conducting paths are formed between the first and third antenna elements and between the second and fourth antenna elements. As shown in the next box 146, a layer of second dielectric having a cavity for a coaxial cable formed therein is provided. As shown in the next box 148 a ground plane is provided. As shown in the next box 150, the assembly is formed by placing the layer of second dielectric on the ground plane and the layer of first dielectric with the antenna elements formed thereon is placed on the layer of first dielectric. As shown in the next box 152 conduction paths are formed between the ground plane and the second antenna element. As shown in the next box 154, the coaxial cable is connected to the antenna assembly. As shown in the next box 156 the assembly is encapsulated if desired. The steps shown in FIG. 10 have been previously described in greater detail.

While the invention has been particularly shown and described with reference to the preferred embodiments thereof, it will be understood by those skilled in the art that various changes in form and details may be made without departing from the spirit and scope of the invention.

What is claimed is:

1. An antenna; comprising:

a layer of first dielectric material having a first surface and a second surface;

a first antenna element formed on said first surface of said layer of first dielectric material;

a second antenna element formed on said first surface of said layer of first dielectric material;

an insulating gap separating said first antenna element from said second antenna element except for a first shorting strip and a second shorting strip forming conducting paths from said first antenna element to said second antenna element, wherein said to insulating gap has a first width, said first shorting strip has a second width, and said second shorting strip has said second width;

a third antenna element having a first length, a first end, and a second end formed on said second surface of said layer of first dielectric, wherein part of said third antenna element has a third width, part of said third antenna element has a fourth width, and said first length is an integral multiple of one quarter of the wavelength of a first frequency;

a first input/output connection region in said second end of said third antenna element;

a fourth antenna element having a second length, a first end, and a second end formed on said second surface of said layer of first dielectric, wherein said fourth antenna element has said fourth width and said second length is equal to an integral multiple of one quarter wavelength of a second frequency;

a third shorting strip having a first length and a fifth width, wherein said third shorting strip forms a conducting path between said second end of said third antenna element and said second end of said fourth antenna element;

a conducting path between said first antenna element and said first end of said third antenna element;

a conducting path between said second antenna element and said first end of said fourth antenna element;

a ground plane having a first surface and a second surface;

a second input/output connection region on said first surface of said ground plane;

a layer of second dielectric material between said first surface of said ground plane and said second surface of said layer of first dielectric; and a number of electrical conducting paths between said ground plane and said second antenna element.

2. The antenna of claim 1 further comprising:

a cavity in said layer of second dielectric material exposing said first input/output connection region and said second input/output connection region;

a coaxial cable having a center conductor and a shield extending into said cavity of said layer of second dielectric material, wherein said center conductor is connected to said first input/output connection region and said shield is connected to said second input/output connection region;

a first layer of third dielectric material formed over said second surface of said ground plane;

a second layer of said third dielectric material formed over said layer of first dielectric, said first antenna element, and said second antenna element; and a third layer of said third dielectric material formed between the edges of said first layer of said third dielectric material and said second layer of said third dielectric material thereby encapsulating said antenna in third dielectric material, wherein said coaxial cable extends through said third layer of said third dielectric material.

3. The antenna of claim 2 wherein said third dielectric material is a plastic.

4. The antenna of claim 1 further comprising a cavity in said layer of second dielectric material exposing said first input/output connection region and said second input/output connection region.

5. The antenna of claim 4 further comprising a coaxial cable having a center conductor and a shield extending into said cavity of said layer of second dielectric material, wherein said center conductor is connected to said first input/output connection region and said shield is connected to said second input/output connection region.

6. The antenna of claim 1 further comprising a notch in said layer of first dielectric material and said first antenna element.

7. The antenna of claim 1 wherein said first frequency is between about 136 and 140 megahertz.

8. The antenna of claim 1 wherein said second frequency is between about 148 and 151 megahertz.

9. The antenna of claim 1 wherein said first, second, third, and fourth antenna elements are copper.

10. The antenna of claim 1 wherein the impedance of said antenna is tuned by adjusting the location of said first shorting strip and said second shorting strip.

11. The antenna of claim 1 wherein said first width is about 0.03125 inches.

12. The antenna of claim 1 wherein said conducting path between said first antenna element and said first end of said third antenna element and said conducting path between said second antenna element and said first end of said fourth antenna element comprise conducting vias through said layer of first dielectric material.

13. The antenna of claim 1 wherein said electrical conducting paths between said ground plane and said second antenna element comprise conducting pins.

14. The antenna of claim 1 wherein said number of electrical conducting paths between said ground plane and said second antenna element is two conducting paths.

15. The antenna of claim 1 wherein said first frequency and said second frequency are between about 3 kilohertz and 300 gigahertz.

16. A method of forming and antenna; comprising:

providing a layer of first dielectric material having a first surface, a second surface, a layer of conducting material formed on said first surface, and a layer of conducting material on said second surface;

forming a first antenna element and a second antenna element on said first surface of said layer of first dielectric by etching an insulating gap across said layer of conducting material on said first surface of said layer of first dielectric material except for a first shorting strip and a second shorting strip wherein said insulating gap separates said first antenna element from said second antenna element except for said first shorting strip and said second shorting strip which form conducting paths from said first antenna element to said second antenna element, and wherein said insulating gap has a first width, said first shorting strip has a second width, and said second shorting strip has said second width;

forming a third antenna element, by means of selectively etching said layer of conducting material on said second surface of said layer of first dielectric, wherein said third antenna element has a first length, a first end, and a second end, part of said third antenna element has a third width, part of said third antenna element has a fourth width, said first length is an integral multiple of one quarter of the wavelength of a first frequency, and said second end of said third antenna element has a first input/output connection region;

forming a fourth antenna element, by means of selectively etching said layer of conducting material on said second surface of said layer of first dielectric, wherein said fourth antenna element has a second length, a first end, a second end, said fourth width, and said second length is equal to an integral multiple of one quarter wavelength of a second frequency;

forming a third shorting strip having a first length and a fifth width, by means of selectively etching said layer of conducting material on said second surface of said layer of first dielectric, wherein said third shorting strip forms a conducting path between said second end of said third antenna element and said second end of said fourth antenna element;

forming a conducting path between said first antenna element and said first end of said third antenna element;

forming a conducting path between said second antenna element and said first end of said fourth antenna element;

providing a conducting ground plane having a first surface, a second surface, and a second input/output connection region on said first surface of said ground plane;

providing a layer of second dielectric having a cavity formed therein;

placing said layer of second dielectric material between said first surface of said ground plane and said second surface of said layer of first dielectric so that said cavity exposes said first input/output connection region and said second input/output connection region; and forming a number of electrical conducting paths between said ground plane and said second antenna element.

17. The method of claim 16 further comprising:

providing a coaxial cable having a center conductor and a shield extending into said notch of said layer of second dielectric material, wherein said center conductor is connected to said first input/output connection region and said shield is connected to said second input/output connection region;

forming a first layer of third dielectric material over said second surface of said ground plane;

forming a second layer of said third dielectric material over said layer of first dielectric, said first antenna element, and said second antenna element; and forming a third layer of said third dielectric material between the edges of said first layer of said third dielectric material and said second layer of said third dielectric material thereby encapsulating said antenna in third dielectric material, wherein said coaxial cable extends through said third layer of said third dielectric material.

18. The method of claim 17 wherein said third dielectric material is a plastic.

19. The method of claim 16 further comprising a coaxial cable having a center conductor and a shield extending into said cavity of said layer of second dielectric material, wherein said center conductor is connected to said first input/output connection region and said shield is connected to said second input/output connection region.

20. The method of claim 16 further comprising a notch in said layer of first dielectric material and said first antenna element.

21. The method of claim 16 wherein said first frequency is between about 136 and 140 megahertz.

22. The method of claim 16 wherein said second frequency is between about 148 and 151 megahertz.

23. The method of claim 16 wherein said first, second, third, and fourth antenna elements are copper.

24. The method of claim 16 wherein the impedance of said antenna is tuned by adjusting the location of said first shorting strip and said second shorting strip.

25. The method of claim 16 wherein said first width is about 0.03125 inches.

26. The method of claim 16 wherein said conducting path between said first antenna element and said first end of said third antenna element and said conducting path between said second antenna element and said first end of said fourth antenna element comprise conducting vias through said layer of first dielectric material.

27. The method of claim 16 wherein said electrical conducting paths between said ground plane and said second antenna element comprise conducting pins.

28. The method of claim 16 wherein said number of electrical conducting paths between said ground plane and said second antenna element is two conducting paths.

29. The method of claim 16 wherein said first frequency and said second frequency are between about 3 kilohertz and 300 gigahertz.

* * * * *